US006990952B2

(12) United States Patent
Imai et al.

(10) Patent No.: US 6,990,952 B2
(45) Date of Patent: Jan. 31, 2006

(54) AIR AMOUNT CONTROL VALVE HAVING VALVE BODY FOR CONTROLLING AIR PASSAGE

(75) Inventors: Douji Imai, Kariya (JP); Akira Furukawa, Kariya (JP); Yuichiro Miura, Obu (JP)

(73) Assignee: Denso Corporation, Kariya (JP)

( * ) Notice: Subject to any disclaimer, the term of this patent is extended or adjusted under 35 U.S.C. 154(b) by 79 days.

(21) Appl. No.: 10/891,040

(22) Filed: Jul. 15, 2004

(65) Prior Publication Data

US 2005/0022780 A1 Feb. 3, 2005

(30) Foreign Application Priority Data

Jul. 31, 2003 (JP) ..... 2003-283512
Feb. 26, 2004 (JP) ..... 2004-052235

(51) Int. Cl.
*F02D 9/08* (2006.01)

(52) U.S. Cl. ..... 123/306; 123/339.25; 123/337; 251/306; 251/368

(58) Field of Classification Search ..... 123/306, 123/337, 339.25; 251/306, 368
See application file for complete search history.

(56) References Cited

U.S. PATENT DOCUMENTS 6,192,784 B1 * 2/2001 Kato et al. ..... 92/71

FOREIGN PATENT DOCUMENTS

| | | |
|---|---|---|
| JP | 2001-271727 | 10/2001 |
| JP | 2002-012987 | 1/2002 |
| JP | 2004-2977 | * 1/2004 |
| JP | 2004-353576 | * 12/2004 |

* cited by examiner

*Primary Examiner*—Tony M. Argenbright
(74) *Attorney, Agent, or Firm*—Nixon & Vanderhye P.C.

(57) ABSTRACT

An air amount control valve is connected to a sidewall of a throttle body in which a main air passage for supplying intake air into an internal combustion engine is formed. The air amount control valve has a bypass air passage bypassing the main passage and controls an amount of air flowing through the bypass air passage, thereby controlling an idling speed of the engine. The air amount control valve includes an aluminum alloy housing having a valve hole and a rotatable valve body having a valve surface facing a fringe wall of the valve hole. To prevent deposits from adhering to the fringe wall facing the valve surface, an anodic oxide film is formed to cover the fringe wall and further a fluororesin film is formed on the anodic oxide film.

13 Claims, 5 Drawing Sheets

AIR AMOUNT CONTROL VALVE HAVING VALVE BODY FOR CONTROLLING AIR PASSAGE

CROSS-REFERENCE TO RELATED APPLICATION

This application is based upon and claims benefit of priority of Japanese Patent Applications No. 2003-283512 filed on Jul. 31, 2003 and No. 2004-52235 filed on Feb. 26, 2004, the contents of which are incorporated herein by reference.

BACKGROUND OF THE INVENTION

1. Field of the Invention

The present invention relates to a control valve for controlling an amount of air supplied to an internal combustion engine, and more particularly to a control valve for controlling an amount of air bypassing a main air passage. The bypassing air control valve is attached to a throttle body that forms the main air passage therein, and functions to maintain an idling speed of the engine at a predetermined level.

2. Description of Related Art

A process of surface-treatment of an aluminum part formed by die-casting is described in JP-A-2002-12987, for example. In this process, an anodic oxide film (anodized aluminum film) is formed on the aluminum surface before processing in solution containing bivalent metals, and then a fluororesin film is coated on the anodic oxide film.

On the other hand, an idling speed control valve for an internal combustion engine is disclosed in JP-A-2001-271727, for example. The control valve is composed of an aluminum alloy housing formed by die-casting and a valve body that rotates in the housing to change an open area of an air passage formed in the housing. Adhesive particles or materials contained in unburned gas flow back into an air passage in the housing of the control valve. To prevent adhesion of such particles or materials, the surface of the housing that slidably contacts the valve body is coated with a thin resin film made by mixing silicone and polyamide-imide.

In the process disclosed in JP-A-2002-12987, the anodic oxide film can be successfully formed on a flat aluminum surface. However, it is difficult to perfectly cover the aluminum surface having defects or small voids or including an acute-angled portion with the anodic oxide film. When the fluororesin film is coated on such a surface not perfectly covered with the anodic oxide film and heated for curing (as is usually performed), air in the defects or the voids will expand and holes will be made through the fluororesin film. Thus, the fluororesin film is damaged and becomes ineffective as a film for protecting the aluminum surface.

In the control valve disclosed in JP-A-2001-271727, the sliding surface of the aluminum alloy housing is directly coated with the mixture resin of silicone and polyamideimide. However, no corrosion-resistant film is formed underneath the mixture resin film. Therefore, when the housing is exposed to strong corrosive materials (such as acid, alkaline or chlorine compounds), the corrosive materials will infiltrate into the aluminum alloy from edges or fringes of the mixture resin film, and the aluminum alloy material will be corroded.

SUMMARY OF THE INVENTION

The present invention has been made in view of the above-mentioned problem, and an object of the present invention is to provide an improved air amount control valve in which adhesive deposits are prevented from adhering to a fringe wall of a valve hole. Another object of the present invention is to improve corrosion resistance of an aluminum housing used in the air amount control valve.

The air amount control valve is connected to a sidewall of a throttle body in which a main air passage for supplying intake air into an internal combustion engine is formed. A bypass air passage bypassing the main air passage is formed in the air amount control valve, and an idling speed of the engine is controlled by controlling the amount of air flowing through the bypass air passage.

The air amount control valve includes a housing having a valve hole and a valve body rotatably supported in the housing. The valve body is driven to rotate in a predetermined angular range in a swinging manner to thereby change an open area of the valve hole. The housing is made of an aluminum alloy, a magnesium alloy or the like by die-casting. A fringe wall surrounding the valve hole is formed in the housing, so that the inner surface of the fringe wall faces a valve surface of the valve body with a small gap apart from the valve surface.

An anodic oxide film is formed to cover at least the inner surface of the fringe wall, and further a fluororesin film is formed on the anodic oxide film. The fluororesin film is made of polytetrafluoroethylene mixed with silicone that dries at a room temperature. The fluororesin film may be formed by coating, spraying or pasting with adhesive. The double layers of the anodic oxide film and the fluororesin film prevent adhesive particles or materials from adhering to the inner surface of the fringe wall. Thus, the valve body is prevented from being stalled by deposits adhered to the inner surface of the fringe wall.

The anodic oxide film may be formed to cover an entire surface of the housing or to partially cover an area around the fringe wall. The fluororesin film may be formed to cover not only the inner surface of the fringe wall but other portions. In particular, it is preferable to form the fluororesin film to fill or cover defects such as small holes or voids formed on the surface of the housing in the process of die-casting. In this manner, corrosion resistivity of the housing is further enhanced.

The present invention may be applied to air valves other than the idling speed control valve. Other objects and features of the present invention will become more readily apparent from a better understanding of the preferred embodiment described below with reference to the following drawings.

DETAILED DESCRIPTION OF THE PREFERRED EMBODIMENTS

A first embodiment of the present invention will be described with reference to FIGS. 1, 2A and 2B. First, referring to FIGS. 2A and 2B, an entire structure of an air amount control valve as a first embodiment of the present invention will be described. The air amount control valve shown here is an idling speed control valve (ISCV) that controls an amount of air passing through a bypass passage formed in parallel to a throttle valve (not shown) for supplying air to an internal combustion engine. By controlling the amount of air passing through the bypass passage, the idling speed of the internal combustion engine is controlled.

Figure 2A:
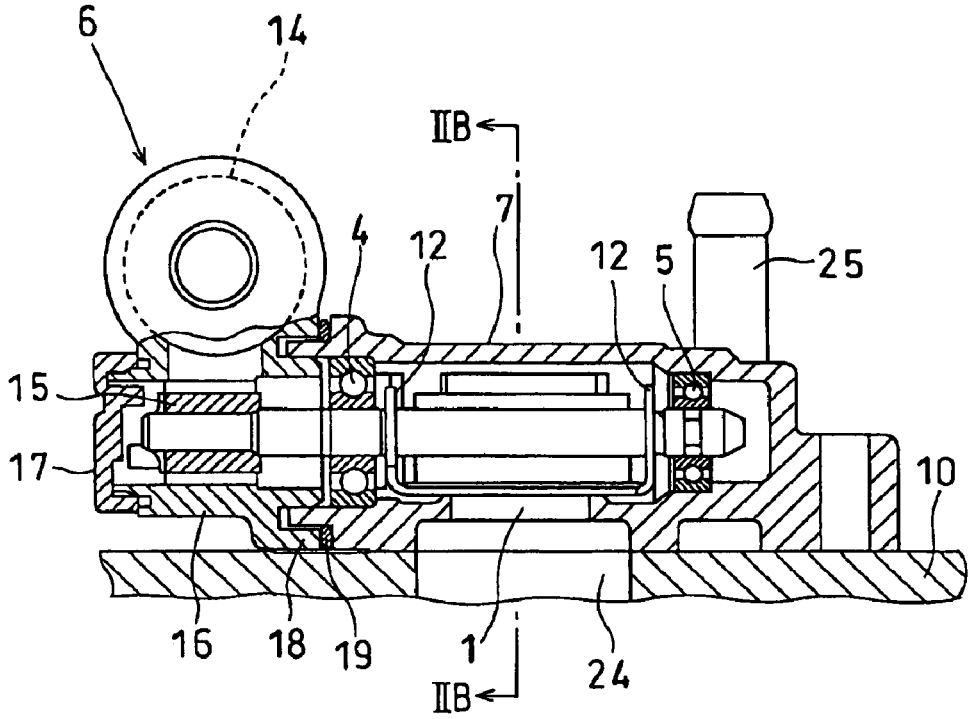
FIG. 2A is a cross-sectional view showing an air amount control valve, taken along a longitudinal direction.
Figure 2B:
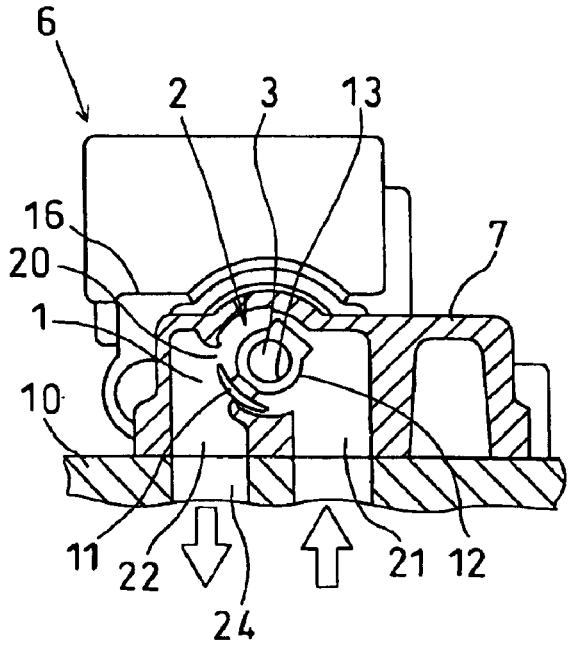
FIG. 2B is a cross-sectional view showing the air amount control valve, taken along line IIB—IIB in FIG. 2A.

As shown in FIGS. 2A and 2B, the air amount control valve is composed of: a housing 7 connected to a sidewall of a throttle body 10; a bypass passage 1 formed in the housing 7; a valve body 2 rotatably supported in the housing 7 for changing a size of the bypass passage 1; a shaft 3 supported by a pair of roller bearings 4, 5 and connected to the valve body 2; a motor actuator 6 for driving the shaft 3; and other associated components. The valve body 2 is made of a metallic material such as stainless steel, and is rotatably driven in a predetermined angular range in a swinging manner to thereby control an open area of a valve hole 20 formed in the housing 7. The valve body 2 is supported on the shaft 3 by a pair of valve holders 12.

Figure 1:
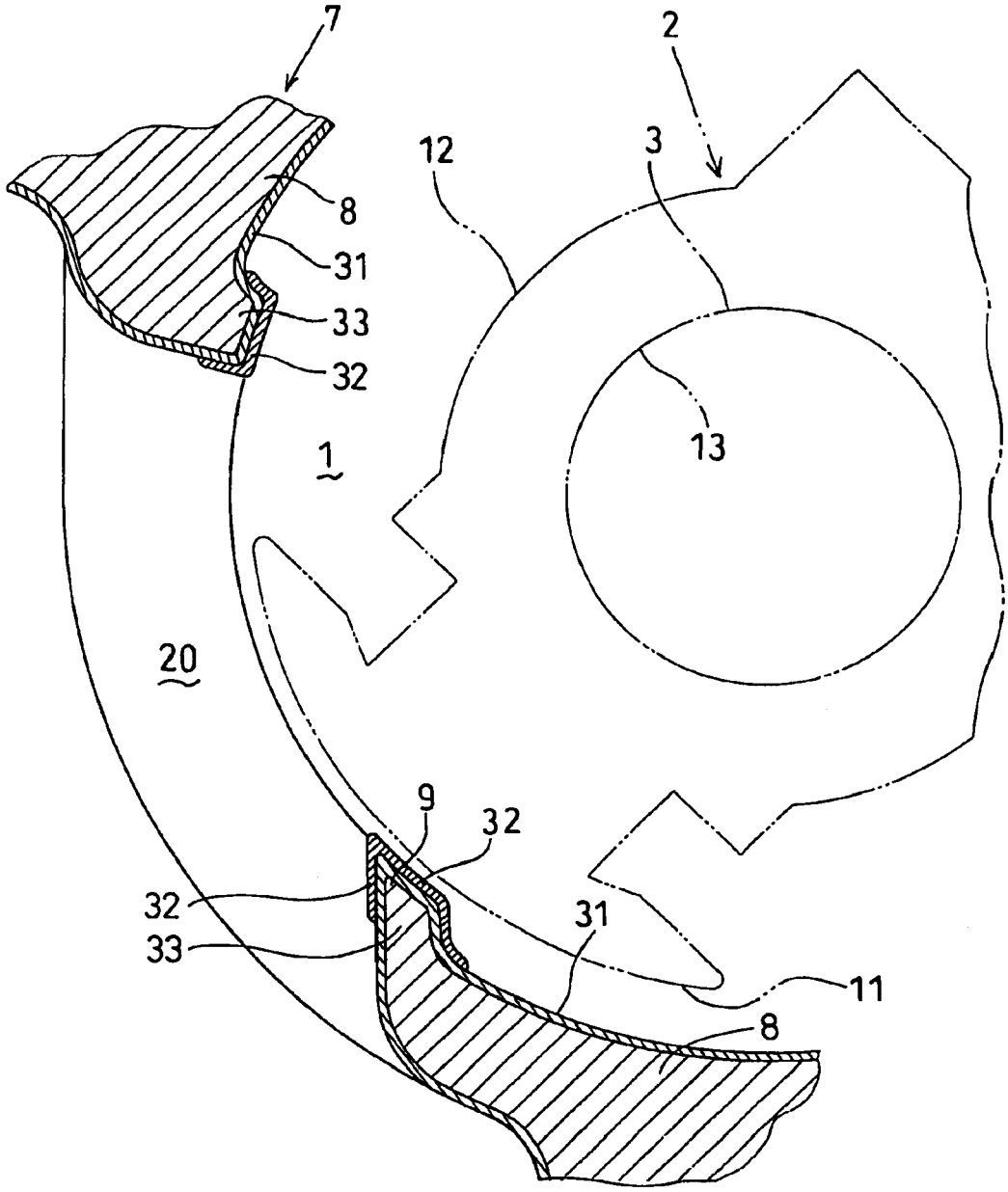
FIG. 1 is a plan view showing a fringe wall around a valve hole in a first embodiment of the present invention in an enlarged scale.

As shown in FIG. 1, the valve body 2 has a valve surface facing a seal wall 8 formed in the housing 7 with a certain gap apart from the seal wall 8. A valve hole 20 in a rectangular shape is formed in the housing 7, and a fringe wall 33 surrounding the valve hole 20 is formed, so that the inner surface of the fringe wall 33 faces the valve surface 11 forming a small gap therebetween, or the inner surface of the fringe wall 33 slidably contacts the valve surface 11. The shaft 3 made of a material such as stainless steel is fixedly inserted into a through hole 13 of the valve body 2. One end of the shaft 3 (the left side in FIG. 2A) is connected to the motor-actuator 6 to be driven thereby.

The motor-actuator 6 is composed of: a field coil 14 to which electric current is supplied in a manner controlled by an electric control unit (not shown); a stator core magnetized by the field coil 14; a rotor magnet 15 fixedly connected to one end of the shaft 3; an actuator casing 16 in which the field coil 14 and the rotor magnet 15 are housed; and an end cover 17 closing the axial end of the actuator casing 16. The field coil 14 is wound around a cylindrical bobbin and connected to molded terminals. The actuator case 16 is connected to the housing 7 by connecting an engaging end 18 to the axial end of the housing 7. An O-ring 19 is disposed in the portion connecting the housing 7 and the actuator casing 16.

The housing 7 is made of an aluminum alloy (aluminum containing Cu and Si) by die-casting. The housing 7 is a die-cast product corresponding to JIS-standard ADC 12, for example. As shown in FIGS. 2A and 2B, the housing 7 is connected to a sidewall of a throttle body 10, and an inlet port 21 and an outlet port 22 of the bypass passage 1 are open to a main air passage 24 in the throttle body 10. The inlet port 21 is open to the main air passage 24 at an upstream side of a throttle valve, while the outlet port 22 is open to the main air passage 24 at a downstream side of the throttle valve. The inlet port 21 and the outlet port 22 are connected to the bypass passage 1 in a U-shape. A hot water passage (not shown) is formed in the housing 7 to prevent freezing in the wintertime, and the hot water is introduced from an inlet pipe 25.

As shown in FIG. 1, the fringe wall 33 surrounding the valve hole 20 and facing the valve surface 11 with a small gap therebetween includes an acute-angled portion 9 formed at a tip of the fringe wall 33. An anodic oxide film 31 is formed to cover an entire surface of the housing 7 to improve resistivity against corrosion or oxidation. The fringe wall 33 including the acute-angled portion 9 is further covered with a fluororein film 32 formed on the anodic oxide film 31. The fluororesin film 32 is made of polytetrafluorethylene resin including silicone that can be dried at a room temperature.

Now, a process of die-casting the housing 7 and a process of coating the housing 7 with the anodic oxide film 31 and the fluororesin film 32 will be briefly explained. Molten aluminum is supplied into a die-casting die with a piston under a high pressure, e.g., 200–300 kgf/cm$^2$. To form the anodic oxide film 31 covering the entire surface of the housing 7, the housing 7 is dipped into an acid solution having a proper density (such as chromic acid, sulfuric acid, oxalic acid or a mixture of those) Then, a voltage lower than 50 volts is applied to the housing 7, using the housing 7 as a plus electrode, while keeping the acid solution at a temperature lower than 40° C. Thus, the anodic oxide film 31 covering the entire surface of the housing is formed.

In the process of forming the anodic oxide film 31, a number of small holes, which are not desirable, may be formed in the anodic oxide film 31. In this case, it is preferable to close such small holes by penetrating a proper material into the holes thereby to improve the resistivity of the film 31 against corrosion. To promote the penetration of the material into the small holes, the housing 7 is put in a tank filled with steam pressurized under about 4–5 kgf/cm$^2$. Alternatively, it may be preferable to dip the housing 7 in hot water or liquid containing nickel salt. The anodic oxide film 31 is preferably formed with a thickness of 5–15 $\mu$m, and most preferably with a thickness of 10 $\mu$m.

Then, the surfaces of the fringe wall 33 (including inner surface and the side surfaces as shown in FIG. 1) are further covered with another film, i.e., a fluororesin film 32 such as polytetrafluoroethylene (PTFE) mixed with silicone that dries at a room temperature. The fluororesin film 32 is coated on the anodic oxide film 31 with a brush. The thickness of the fluororesin film 32 is preferably made in a range 5–30 $\mu$m, and it is most preferable to make it 15 $\mu$m. The fluororesin film 32 may be formed by spraying or painting, or coating at a high temperature. If the anodic oxide film 31 is not properly formed to cover the acute-angled portion 9, the fluororesin film 32 is coated to cover the fringe of the anodic oxide film 31 or to cover portions where the anodic oxide film 31 is not formed.

The air amount control valve described above operates in the following manner. Upon energizing the field coil 14, the valve body 2 is driven by the motor-actuator 6. When the valve body 2 rotates to a position where the valve surface 11 closes the valve hole 20, the bypass air passage 1 is fully closed. Upon de-energizing the field coil 14, the valve body 2 is rotated in a reverse direction by a biasing force applied to the valve body 2 thereby to open the valve hole 20. The open area of the valve hole 20 is controlled according to an amount of current supplied to the field coil 14. Thus, the amount of air flowing through the bypass air passage 1 is controlled.

Following advantages are attained in the first embodiment described above. Since the surface of the fringe wall 33 facing the valve surface 11 is covered with two film layers, i.e., the anodic oxide film 31 and the fluororesin film 32, the housing 7 can be formed from various materials including materials which are not excellent for die-casting. That is, aluminum alloys such as ADC-6, ADC-10 may be used in place of ADC-12. By covering the surface of the fringe wall 33 with double layer films 31, 32, a high corrosion resistivity can be given to the housing 7.

Since PTFE mixed with silicone that dries at a room temperature is used to form the fluororesin film 32, defects on-the anodic oxide film 31, such as small holes or voids, can be easily covered with the fluororesin film 32. In particular, the acute-angled portion 9 which is difficult to be perfectly covered with the anodic oxide film 31, can be properly covered with the fluororesin film 32. The fluororesin film 32 is coated to cover such portions where the defects of the anodic oxide film 31 tend to be formed or where no anodic oxide film 31 is formed.

Since the fluororesin film 32 includes both of silicone and polytetrafluoroethylene (PTFE), corrosive materials (such as strong acid, strong alkaline, chlorine compounds, salt water and condensed water) arriving at the inner surface of the fringe wall 33 are prevented from adhering thereto. Similarly, adhesive materials (such as adhesive particles contained in unburned gas, sludge or carbon) are prevented from adhering to the surface of the fringe wall 33 facing the valve surface 11. Thus, the valve surface 11 is prevented from sticking to the inner surface of the fringe wall 33, and therefore the valve body 2 can be smoothly rotated.

When the air amount control valve described above is used as an engine speed control valve that controls an amount of air bypassing the throttle valve, operation of the engine can be smoothly and economically controlled because there is no chance that the air amount control valve comes to a stall.

Though only the surface of the fringe wall 33 including the acute-angled portion 9 is covered with the fluororesin film 32 in the first embodiment, it is also possible to cover other portions with the fluororesin film 32. That is, portions where the anodic oxide film 31 is not formed or difficult to be formed and portions where defects such as small holes or voids exist on the anodic oxide film 31 may be covered with the fluororesin film 32. The fluororesin film 32 may be partially formed to cover such portions by coating, spraying or pasting with adhesive. In this manner, the aluminum alloy material is protected from being corroded if a highly corrosive material adheres to the surface of the housing 7. The corrosive material is prevented from penetrating into the aluminum alloy through the defects on the anodic oxide film 31 by covering such defects with the fluororesin film 32. As the fluororesin film 32, other materials such as polychlorofluoroethylene or polyfluorovinyl may be used in place of polytetrafluoroethylene.

Figure 3:
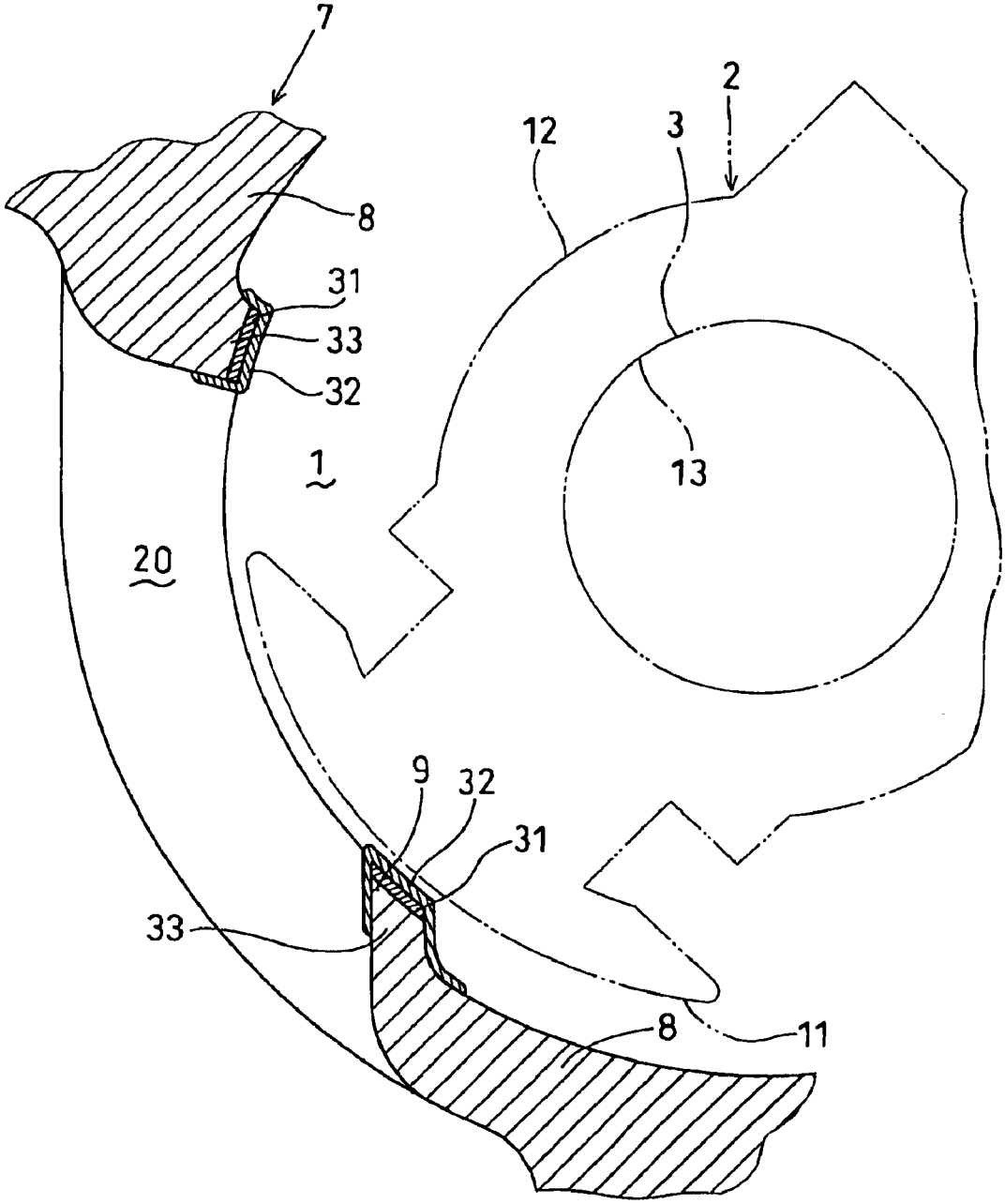
FIG. 3 is a plan view showing a fringe wall around a valve hole in a second embodiment of the present invention in an enlarged scale.
Figure 4A:
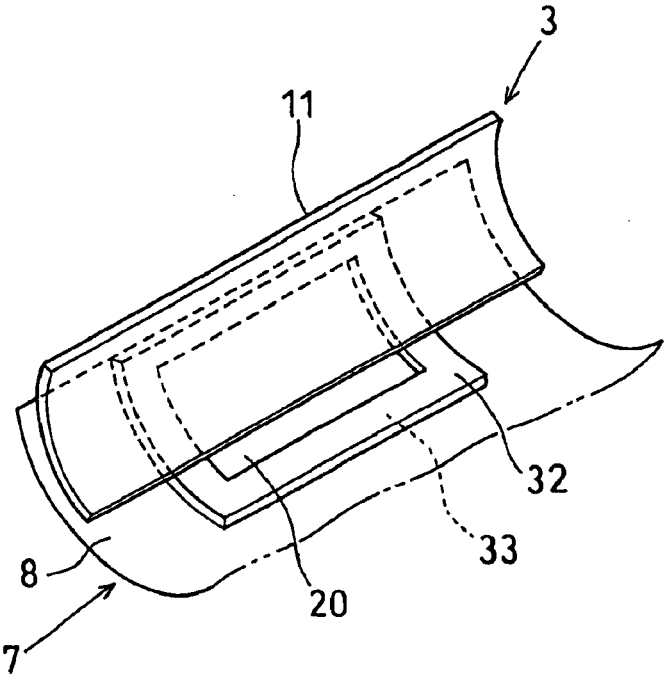
FIG. 4A is a schematic view showing a valve hole and its vicinity in the second embodiment shown in FIG. 3.
Figure 4B:
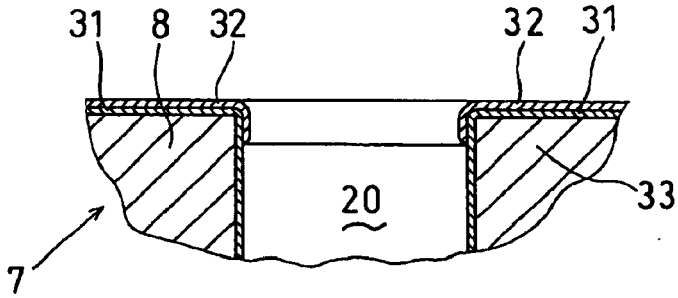
FIG. 4B is a partial cross-sectional view showing the valve hole and its vicinity in the second embodiment shown in FIG. 3.

A second embodiment of the present invention is shown in FIGS. 3, 4A and 4B. In this embodiment, the anodic oxide film 31 is not formed to cover the entire surface of the housing 7, but it is formed to cover only the inner surface of the fringe wall 33, as shown in FIG. 3. The inner surface of the fringe wall 33 where the anodic oxide film 31 is formed and the sidewalls of the fringe wall 33 are covered with the fluororesin film 32. If the anodic oxide film 31 is difficult to be formed on the acute-angled portion 9, then the fluororesin film 32 is formed to cover the fringe portions of the anodic oxide film 31 or to cover portions where the anodic oxide film 31 is not formed.

Figure 5:
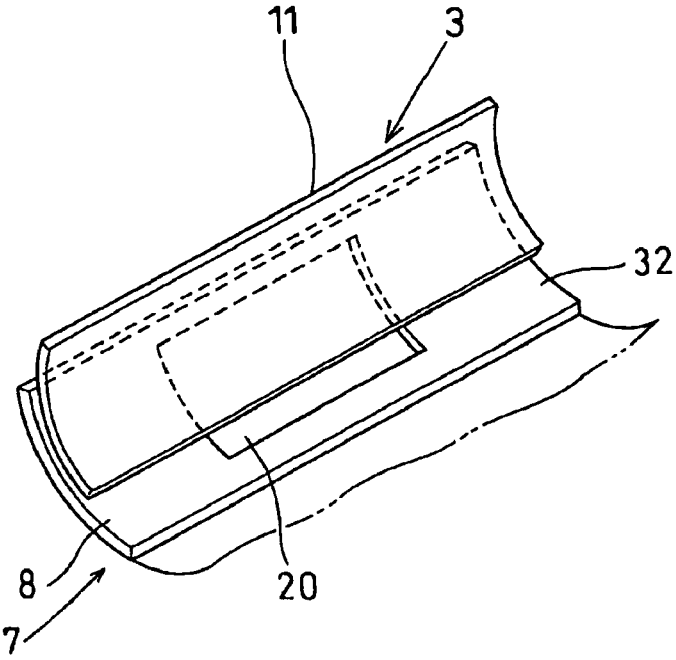
FIG. 5 is a schematic view showing a valve hole and its vicinity in a third embodiment of the present invention.

A third embodiment of the present invention is shown in FIG. 5. In this embodiment, the anodic oxide film 31 is formed to cover an entire surface of the seal wall 8. The fluororesin film 32 is coated on the anodic oxide film 31.

Figure 6A:
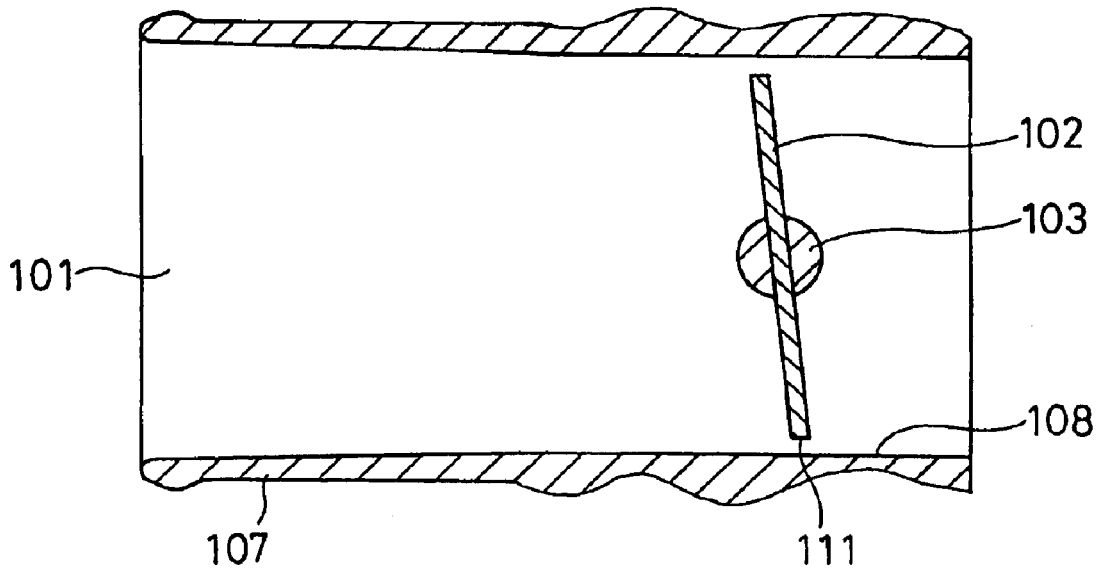
FIG. 6A is a cross-sectional view showing a cylindrical housing in which a butterfly valve is rotatably disposed, as a fourth embodiment of the present invention.
Figure 6B:
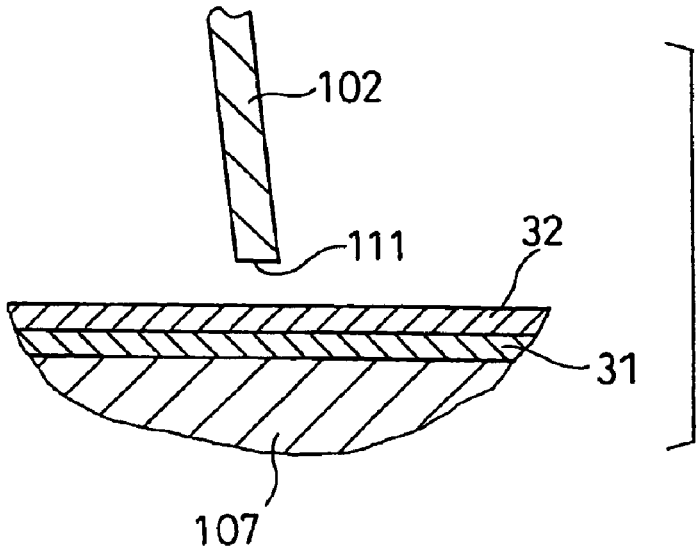
FIG. 6B is a partial cross-sectional view showing an inner bore of the cylindrical housing shown in FIG. 6A, in an enlarged scale.

A fourth embodiment of the present invention is shown in FIGS. 6A and 6B. In this embodiment, the present invention is applied to an air passage control device having a butterfly valve 102. Acylindrical housing 107 is made of an aluminum alloy by die-casting. The butterfly valve 102 supported by a shaft 103 is rotatably disposed in an inner bore 108 of the cylindrical housing 107. The butterfly valve 102 is disc-shaped and is made of stainless steel, brass or the like. The outer periphery 111 of the disc-shaped butterfly valve 2 faces the inner bore 108 of the cylindrical housing 107 with a certain gap apart therefrom.

As the butterfly valve 102 is rotated by the shaft 103, the gap between the outer periphery 111 of the butterfly valve 102 and the inner bore 108 of the cylindrical housing 107 is widened or narrowed. In this manner, an open area of an air passage 101 in the cylindrical housing 107 is changed according to the rotation of the shaft 103. Thus, an amount of air passing through the air passage 101 is changed.

As shown in FIG. 6B, an entire surface of the inner bore 108 of the cylindrical housing 107 is covered with the anodic oxide film 31 having a predetermined thickness. The inner bore 108 is further covered with the fluororesin film 32 formed on the entire surface of the anodic oxide film 31. Thus, corrosive particles or the adhesive particles are prevented from adhering to the inner bore 108.

The present invention is not limited to the embodiments described above, but it maybe variously modified. For example, the present invention may be applied to a main air passage in a throttle body, through it is applied to the bypass air passage of the idling speed control valve in the foregoing embodiments. Further, the present invention may be applied to other air control valves, electronically controlled throttle valves or the like.

This invention may be applied to a so-called swirl control valve that generates lateral swirls in air sucked into a combustion chamber of an internal combustion engine. This invention may be also applied to a so-called tumble control valve that generates longitudinal swirls in the sucked air. Further, this invention may be applied to an intake air control valve in which a length or an open area of an air passage is changed according to rotational speed of an internal combustion engine. In this type of intake air control valve, two intake air passages having respectively different lengths and open areas are connected to an intake manifold, branching out therefrom. Either one of the two intake air passages is selectively opened by a valve body disposed in the air control valve. For example, one air passage having a longer length is used when the engine is running at a low or a middle speed, while the other air passage having a shorter length is used when the engine is running at a high speed. Thus, an output torque of the engine is increased throughout an entire speed range.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An air amount control valve comprising:

a housing;

a valve hole formed in the housing;

a valve body having a valve surface for changing an open area of the valve hole, thereby controlling an amount of air flowing through the valve hole;

a seal wall formed in the housing, the seal wall facing the valve surface with a gap apart from the valve surface; and a fringe wall surrounding the valve hole and projecting from the seal wall toward the valve surface so that the fringe wall slidably contacts the valve surface or faces the valve surface with a small gap apart from the valve surface, the small gap being smaller than the gap between the seal wall and the valve surface, wherein:

an anodic oxide film is formed to cover at least an inner surface of the fringe wall that faces the valve surface; and a fluororesin film made of polytetrafluoroethylene mixed with silicone that dries at a room temperature is formed on the anodic oxide film to cover at least the inner surface of the fringe wall.

2. The air amount control valve as in claim 1, wherein:

the anodic oxide film is formed to cover an entire surface of the housing.

3. The air amount control valve as in claim 1, wherein:

the anodic oxide film is formed to cover the seal wall of the housing.

4. The air amount control valve as in claim 1, wherein:

the fluororesin film is formed to further cover portions where the anodic oxide film is not properly formed.

5. The air amount control valve as in claim 1, wherein:

the housing is made of either an aluminum alloy or an magnesium alloy by die-casting; and the fluororesin film is formed to further cover portions of the housing surface where small defects formed in a process of die-casting exist.

6. The air amount control valve as in claim 1, wherein:

the fluororesin film is formed on the anodic oxide film by a method of selected from a group consisting of coating, spraying and pasting with adhesive.

7. The air amount control valve as in claim 1, wherein:

the fringe wall includes an acute-angled portion; and the fluororesin film is formed to completely cover the acute-angled portion.

8. The air amount control valve as in claim 1, wherein:

the valve body is a valve rotated by a shaft in a predetermined angular range in a swinging manner.

9. The air amount control valve as in claim 1, wherein:

the housing is a cylindrical body having an inner bore, and the valve body is a butterfly valve in a disc shape having an outer periphery;

the valve body is rotatably supported in the inner bore of the housing, forming a gap between the inner bore of the housing and the outer periphery of the valve body; and a size of the gap is changed according to rotation of the valve body to thereby control amount of air flowing through the gap.

10. The air amount control valve as in claim 1, wherein:

the air amount control valve forms therein a bypass air passage bypassing a main air passage in a throttle valve for an internal combustion engine and controls an amount of air flowing through the bypass air passage to thereby control rotational speed of the internal combustion engine.

11. The air amount control valve as in claim 1, wherein:

the air amount control valve is used as a swirl control valve that generates lateral swirls in an air flow sucked into an internal combustion engine.

12. The air amount control valve as in claim 1, wherein:

the air amount control valve is used as a tumble control valve that generates longitudinal swirls in an air flow sucked into an internal combustion engine.

13. The air amount control valve as in claim 1, wherein:

the air amount control valve is used as an intake air control valve for an internal combustion engine, the intake air control valve having an air passage, a length and an open area of which can be varied according to rotational speed of the internal combustion engine.

* * * * *